United States Patent [19]

Kim

[11] Patent Number: 4,669,285

[45] Date of Patent: Jun. 2, 1987

[54] LOCK ASSEMBLY WITH A CHANGEABLE LOCKING COMBINATION

[76] Inventor: Guy N. Kim, 1001-4 Jooahn 1-Dong, Nam-ku, Inchon, Rep. of Korea

[21] Appl. No.: 798,971

[22] Filed: Nov. 18, 1985

[51] Int. Cl.[4] ..... E05B 37/02

[52] U.S. Cl. ..... 70/312; 70/316

[58] Field of Search ..... 70/312, 316, 304, 287, 70/288

[56] References Cited

U.S. PATENT DOCUMENTS

| | | | |
|---|---|---|---|
| 379,508 | 3/1888 | Drake | 70/316 X |
| 437,034 | 9/1890 | Mundt | 70/304 X |
| 809,556 | 1/1906 | Druehl | 70/304 |
| 1,802,041 | 4/1931 | Adams | 70/304 |

FOREIGN PATENT DOCUMENTS

| | | | |
|---|---|---|---|
| 375139 | 5/1923 | Fed. Rep. of Germany | 70/312 |
| 6433 | 12/1901 | United Kingdom | 70/304 |

*Primary Examiner*—Robert L. Wolfe

*Attorney, Agent, or Firm*—Birch, Stewart, Kolasch & Birch

[57] ABSTRACT

The present invention relates to a lock assembly with a changeable combination lock which can be used for luggage cases or the like. The lock assembly comprises a lock member having a plurality of grooves corresponding to a series of dial members and a clasp member having a tongue for engaging or releasing from the grooves of the lock member. The dial member has an inner member containing an aperture so that the direction of the groove can be easily changed on the face plate of the dial member for insuring the safety of the luggage case.

4 Claims, 6 Drawing Figures

LOCK ASSEMBLY WITH A CHANGEABLE LOCKING COMBINATION

BACKGROUND OF THE INVENTION

The present invention relates to a lock assembly with a changeable combination and more particularly to a changeable combination lock for use in briefcases or luggage cases or the like, which are provided with keyless combination locking systems.

There are many types of latching devices which are well known in the art which utilize combination locking systems of the dial-type which include a manually operable latching member cooperable with a clasp. However, these devices suffer from a number of difficulties such as, for example, they have a fixed combination of numbers for releasing the latching mechanism of the briefcases or luggage cases which makes it impossible to change the combination and thus presents a safety problem, or at most, these prior art devices have a narrow range of numerical combinations.

OBJECT AND SUMMARY OF THE INVENTION

Accordingly, it is an object of the present invention to provide an improved lock assembly with a changeable lock combination for use in briefcases or luggage cases.

Another object of the present invention is to provide a lock assembly wherein the combination is easy to change for releasing the locking mechanism of the cases.

A further object of the present invention is to provide a lock assembly which has a large range of combinations of dial numbers for releasing the latched members.

Still another object of the present invention is to provide a lock assembly which safely protects the contents of the article being locked.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention provides a lock assembly with changeable numerical combinations for briefcases or luggage cases or the like which is simple to manufacture, and provides for easily changing the numbers for releasing the locking mechanism, thereby increasing the element of safety for briefcases or luggage cases.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
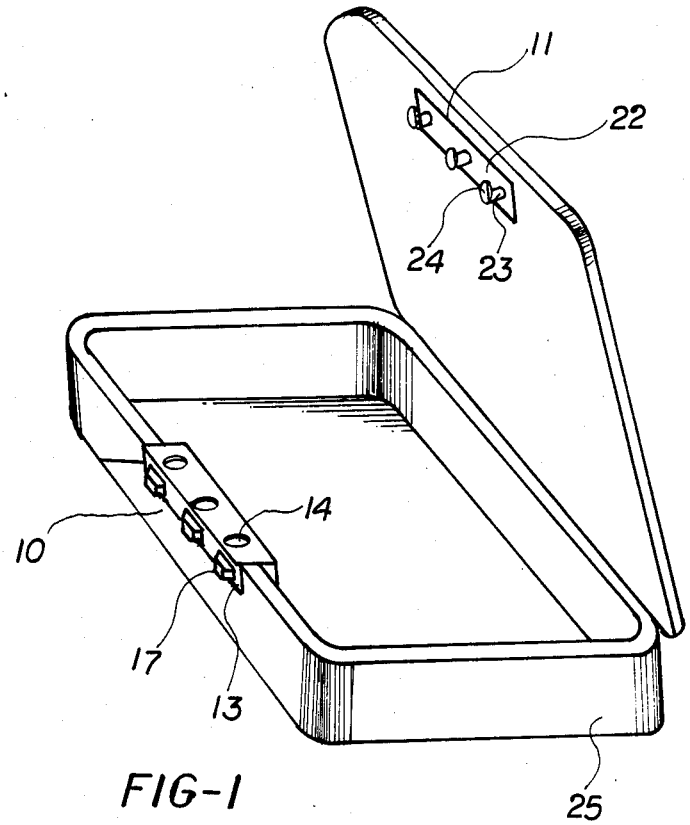
FIG. 1 is a perspective view of a briefcase utilizing a lock assembly with the changeable locking combination of the present invention.
Figure 2:
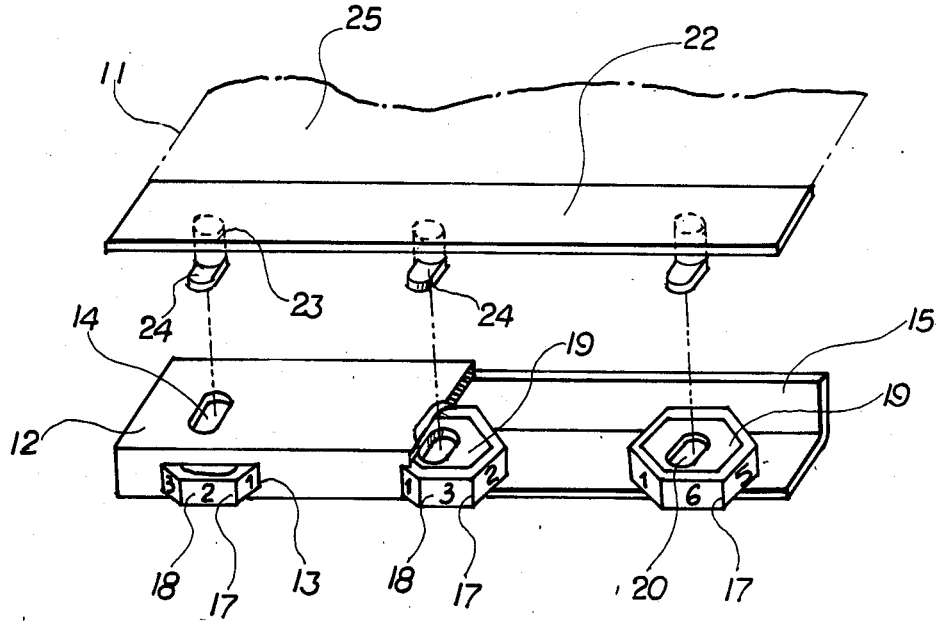
FIG. 2 is an enlarged view of a lock assembly with the changeable combination of FIG. 1.
Figure 3:
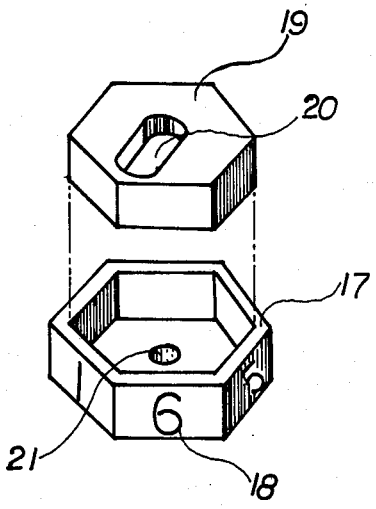
FIG. 3 is an enlarged view of a dial member of the lock assembly of the present invention.
Figure 4:
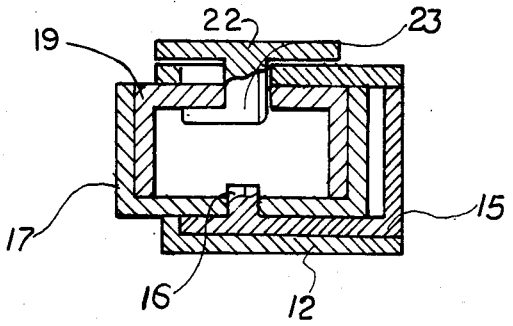
FIG. 4 is a cross-sectional view showing the lock assembly in a locked position.
Figure 5:
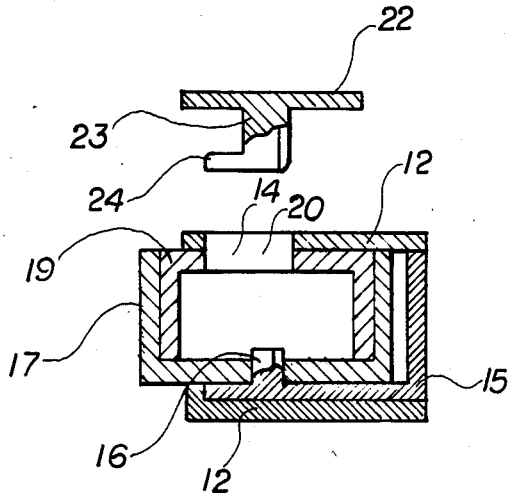
FIG. 5 is a cross-sectional view showing the lock assembly in a released position.

Referring in detail to the drawings for the purpose of illustrating the present invention, the lock assembly with a changeable numerical combination as shown in FIGS. 1 and 2 comprises a lock combination assembly 10 for cooperation with a clasp or latch assembly 11. The lock combination assembly comprises a "L"-shaped case 12 including a series of rectangular grooves 13 disposed at the front side thereof and a series of elliptical grooves 14 disposed at the top thereof. An "L"-shaped base 15 is provided with a plurality of studs 16 for rotatably securing a corresponding number of numerical dial members 17 thereto through apertures 21 provided in the base 15 (FIGS. 3,4 and 5). The dial members 17 are each provided with indicia or numbers from, e.g., 0 to 9 in equidistant spaced flat faces on the outer periphery of the dial member 17. An inner dial member 19 containing a centrally disposed elliptical groove 20, is configured similarly as the dial members 17 so as to slidably fit within said dial member. The "L"-shaped base 15 is adapted to fit within the "L"-shaped case 12 forming a rectangularly shaped closure with exposed dial members.

The clasp or latch assembly 11 comprises a plate 22 and a plurality of clasps 23 having a tongue 24 disposed at the end thereof for engaging in the elliptical grooves 14 and 20 of the lock assembly 10.

As shown in FIG. 1, the lock combination assembly 10 and the clasp assembly 11 are secured to the base and the cover, respectively, of the luggage case 25 by any conventional means.

Figure 6:
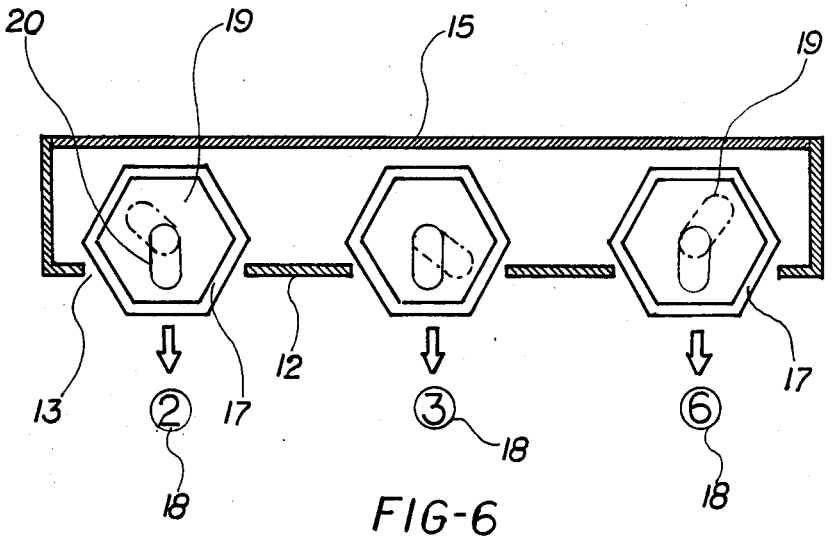
FIG. 6 is a cross-sectional view showing an example of the lock-releasing system of the present invention.

In operation, for example, if the user decides to use the combination of numbers 2, 3 and 6 to release the lock, as shown in FIG. 6, the inner dial members 19 are inserted into the dial members 17 with the direction of the elliptical grooves 20 being in common alignment behind numbers 2, 3 and 6. After assembling, and when the cover of the briefcase 25 is covered and the dial number 18 is turned, the clasp assembly 11 is locked by the lock combination assembly 10. At this time, when the previously selected numbers 2, 3 and 6 are located at the front face plate of the dial members 17, the lock assembly 10 is easily released. If it is desired to change the numerical lock combination, the inner dial members 19 can be positioned behind a different series of numbers in the manner discussed above which provides flexibility and added safety in the locking system. Also, the lock assembly is inexpensive to manufacture because its construction is simple, and it can be constructed of plastic or the like.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A lock assembly having a changeable combination which comprises:

a clasp assembly and a lock combination, said clasp assembly being adapted to fixedly engage said lock combination, said lock combination including a base member, a plurality of external dial members rotatably connected to said base member, each of said dial members containing a sequence of numerical indicia on the surface, and a plurality of internal dial members slidably disposed within corresponding external dial members, said internal dial members containing an aperture therein which is adapted to receive locking members of said clasp assembly, wherein upon proper alignment of said apertures corresponding to the desired numerical combination, the lock assembly can be locked and/or unlocked.

2. The lock assembly of claim 1, wherein the base member is provided with stud members which engage the bottom of said external dial members so that the external dial members are rotatably selective to said base member.

3. The lock assembly of claim 2, wherein the external dial member has a top open face for slidably receiving the internal dial member therein.

4. The lock assembly of claim 3, wherein both the external dial members and the internal dial members are provided with a plurality of corresponding angular surfaces which prevent relative rotation between said elements.

* * * * *